US007021783B2

(12) United States Patent
Quittner

(10) Patent No.: US 7,021,783 B2
(45) Date of Patent: Apr. 4, 2006

(54) POCKET LIGHT

(76) Inventor: Brian Quittner, 3918 Via Diego #C, Santa Barbara, CA (US) 93110

( * ) Notice: Subject to any disclaimer, the term of this patent is extended or adjusted under 35 U.S.C. 154(b) by 6 days.

(21) Appl. No.: 10/248,064

(22) Filed: Dec. 13, 2002

(65) Prior Publication Data

US 2003/0112624 A1 Jun. 19, 2003

Related U.S. Application Data

(60) Provisional application No. 60/319,032, filed on Dec. 14, 2001.

(51) Int. Cl.
*F21V 21/08* (2006.01)

(52) U.S. Cl. ..... 362/103; 362/158; 362/196

(58) Field of Classification Search ..... 362/103, 362/158, 196, 200, 201
See application file for complete search history.

(56) References Cited

U.S. PATENT DOCUMENTS 4,234,913 A * 11/1980 Ramme ..... 362/158
D350,618 S 9/1994 Parker
5,410,457 A * 4/1995 Parker ..... 362/205
D383,558 S 9/1997 Parker
5,871,272 A 2/1999 Sharrah et al.
6,012,824 A * 1/2000 Sharrah et al. ..... 362/199
6,250,771 B1 * 6/2001 Sharrah et al. ..... 362/184
6,299,323 B1 * 10/2001 Yu et al. ..... 362/116
6,523,972 B1 2/2003 Sharrah et al.
6,533,436 B1 * 3/2003 Krietzman et al. ..... 362/200
6,612,714 B1 * 9/2003 Morre et al. ..... 362/191

* cited by examiner

*Primary Examiner*—John Anthony Ward
(74) *Attorney, Agent, or Firm*—Michael L. Greenberg; Greenberg & Lieberman LLC

(57) ABSTRACT

The present invention is a pocket light that allows a user to view documents in a dark situation without having to hold a flashlight. The pocket light fits easily over the top of the pocket and can be covered by a conventional pocket flap. The light is an LED display device that produces a significant amount of light so a user could check identification or documentation, as in a license check, or registration verification for police. The pocket light has a push button power switch that can be activated by the user through the fabric of their shirt.

8 Claims, 4 Drawing Sheets

POCKET LIGHT

This application claims the benefit of Provisional application No. 60/319,032, filed Dec. 14, 2001.

BACKGROUND OF INVENTION

The present invention is a flashlight that has an attachment means for fitting on a shirt pocket.

The use of flashlights is imperative to security guards, and police for patrolling and checking identification and documentation. Often the police officer or security guard carries the flashlight on their belt in a holster or clip. However in this situation the user must unhook the flashlight, and position the flashlight in a proper position to see the documentation. Often this includes tucking the flashlight in the fold of the arm at the armpit against the body. The inherent problem with this situation includes lack of use of the hand on the arm holding the flashlight, or trying to juggle documentation and the flashlight in the same hand, or having no hands free while holding the documentation in one hand and the flashlight in the other hand.

U.S. Pat. No. 3,953,722 issued to Stick on Apr. 27, 1976 shows a flashlight support means. Stick's invention is unlike the present invention because it is attached to the wearer by a safety pin, it is larger than the present invention, and the light would not fit under a shirt pocket flap.

U.S. Pat. No. 4,605,990 issued to Wilder et al., on Aug. 12, 1986 shows a surgical clip on light pipe illumination assembly. Wilder's invention is unlike the present invention because the clip is a hinged mechanism that is not as discrete or hidden as the present invention, and the light mechanism cannot be hidden under a shirt pocket flap.

U.S. Design Pat. No. 292,616 issued to Sexton on Nov. 3, 1987 shows a disposable clip light. Sexton's invention is unlike the present invention because when clipped it could not light in a downward direction as is needed to read documentation, and cannot fit underneath a shirt pocket flap.

U.S. Pat. No. 5,029,055 issued to Lindh, on Jul. 2, 1991 shows a portable light. Lindh's invention is unlike the present invention because it is intended to be mounted on a bicycle, would not clip onto a shirt pocket, and would not be covered by the flap on a shirt pocket.

U.S. Design Pat. No. 340, 777 issued to Choi, et al., on Oct. 26, 1993 shows a personal safety light. U.S. Design Pat. No. 362,312 issued to Chen on Sep. 12, 1995 shows a clip-on flashlight. Choi and Chen's inventions are unlike the present invention because they are bulkier, and cannot be easily hidden by a pocket flap as the present invention.

U.S. Pat. No. 4,953,892 issued to Adkins on Sep. 4, 1990 shows a ski pole clip. Adkins' invention is unlike the present invention because it does not have a light mechanism, and it would not fit in a pocket to light identification or documentation.

U.S. Pat. No. 5,541,816 issued to Miserendino on Jul. 30, 1996 shows a clip light source. Miserendino's invention is unlike the present invention because it is a flashlight intended to be attached to a helmet as for a miner, or fireman, it cannot be covered by a shirt pocket flap, and has a hinged mechanism for the light that is bulkier than the present invention.

U.S. Pat. No. 6,027,223 issued to Lackey, et al., on Feb. 22, 2000 shows a writing instrument pocket clip light. Lackey's invention is unlike the present invention because it is a writing instrument, and the light needs to be activated by unfolding the pen clip requiring additional hand coordination.

Therefore, a need has been established for a flashlight that can be hidden by a shirt pocket flap, which can assist policemen or security officers in viewing documents.

SUMMARY OF INVENTION

The present invention is a light that an officer or security guard could wear on their shirt pocket that projects a light in a downward direction. The light is compact and fits in a shirt pocket with a clip mechanism. The main body of the pocket light will fit inside a shirt pocket and there is a 1⅜ inch overlap from the front of the pocket that holds the light source. The pocket light mechanism is completely concealed within the user's pocket and cannot be seen on the wearer until the light source is turned on. The main body of the light source encases the power source for the light and a push switch for turning the light on or off. The push button is sensitive enough to be pushed through the fabric of a shirt pocket and turn the light on or off. In this manner the user can turn on the light and view any documents or light their way in a dark area, such as a theater isle. The present invention is useful to police officers, security guards, ushers, and bouncers at nightclubs or the like.

The light projects at an approximate 30-degree outward and downward angle. Due to the approximate thirty-degree angle the user can hold the documents that need to be read or viewed in their hand at a natural angle without having to place the documents directly underneath the light. Additionally, a hinged member allows the user to move the light up to a ninety degree angle from the main body of the pocket light, allowing for different angles of viewing capacity for the user. Although the light bulb is small and compact, the projection ray of the light is wide enough to project onto a letter sized document easily, and concentrated to make small print reading easier.

An inherent advantage to the present invention is the hand free use, and quick access to a light source. The user can turn on the light through their shirt pocket with the push of a finger and the light can project easily from the underside of the shirt pocket flap allowing the user to have both hands free for handling documents. Currently, with conventional flashlights the user must keep one hand free to operate the flashlight and to hold the flashlight during use.

DETAILED DESCRIPTION

The present invention is a pocket light for viewing documents or merely lighting one's way without having to use a hand held flashlight. The pocket light is small and thin in size to easily fit in any shirt pocket and still leave room for other items. The present invention is made of a high-density or composite type plastic shell casing, a pair of batteries, a power button, and Light Emitting Diode (LED) red, blue or white light display, and a flap mechanism for securing the present invention to a pocket in a secure yet removable fashion.

Figure 1:
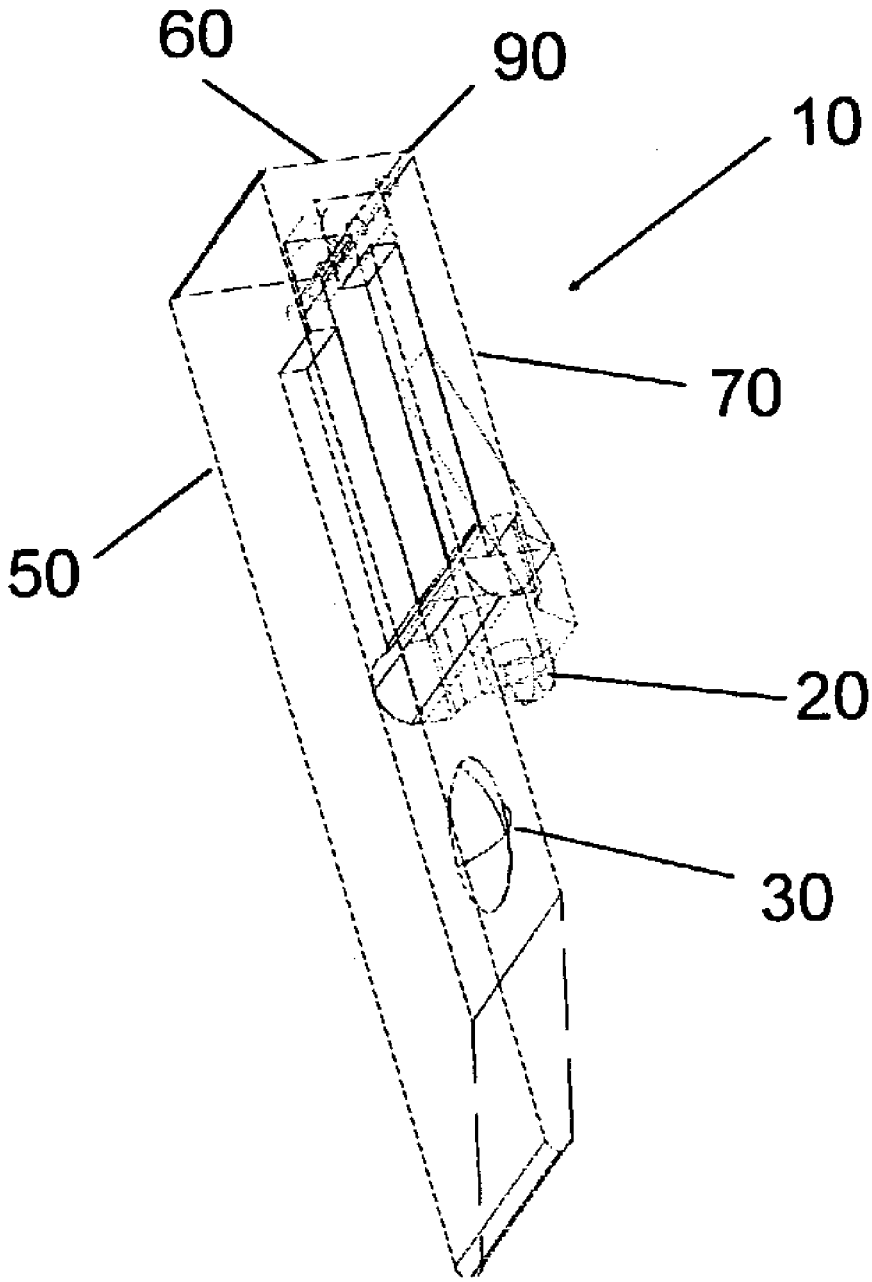
FIG. 1 shows an environmental view of the present invention.
Figure 4:
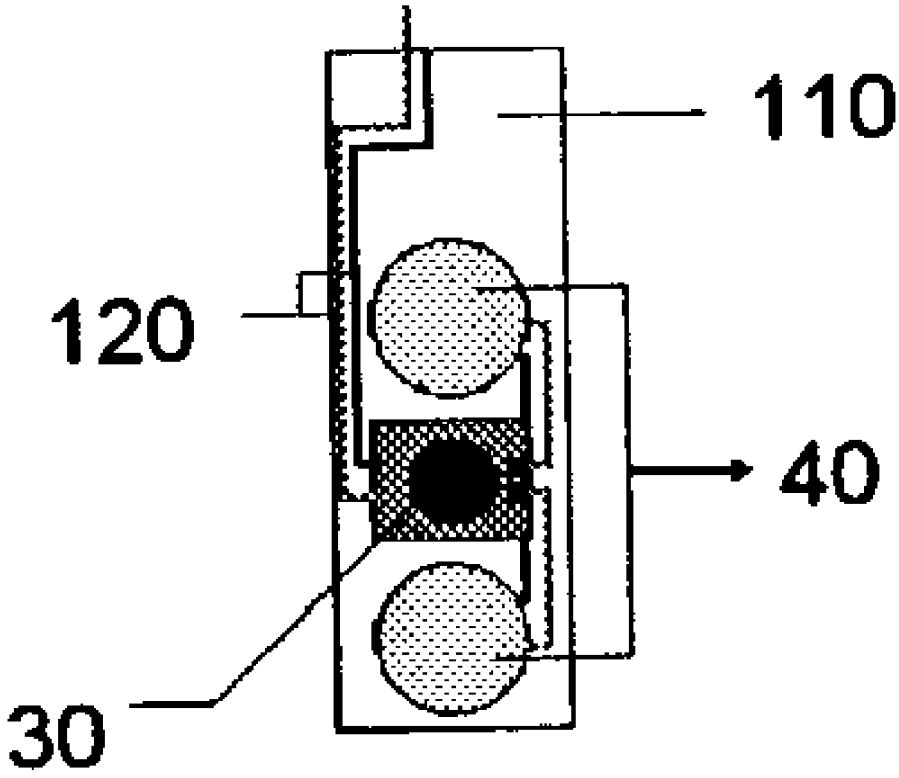
FIG. 4 shows a back view of the present invention.

FIG. 1 shows an environmental view of the pocket light (10). The LED light display (20) is located on the outer casing (70) facing in an approximate 30 degree angle from the back casing (50). The power switch (30) is activated by depressing the switch to activate or deactivate the LED light display (20). The power switch (30) is attached via a wiring system (FIG. 4, 120) connect to a circuit board (FIG. 4, 110) and to a pair of batteries (40). The batteries (40) are long life lithium batteries that can easily be changed through the rear protective door (100) back casing (50), as shown in FIG. 4. In this embodiment the batteries (40) are 3 volts each that supply the LED light with a total of six volts.

The back casing (50) is fixedly connected to the outer casing (70) by a clip member (60). The clip member (60) fastens across the top of a shirt pocket and can easily be concealed by a pocket flap. The clip member (60) communicates with a hinged member (90) to allow the user to move the LED light display (20) up to a 90-degree angle (FIG. 3) from the shirt pocket (not shown). The hinged member (90) can be of a conventional receptor and screw mechanism as in the arm of a pair of glasses. The clip member (60) is fastened to the back casing (50) and is non-adjustable, and is 1/16 inch thick where it communicates with the outer casing (70). The LED light display (20) is situated, in FIG. 1, at an approximate 30-degree angle from the shirt pocket and the outer casing (70), and is therefore at the correct front facing and downward angle to view documents without additional adjustment of the light. The movable pocket light (10) could also be used in alternate embodiments from a car dashboard, or at a crime scene investigation to light pieces of evidence. The LED light display (20) is designed to last thousands of hours before total burn out, allowing the wearer to have long-term use of the pocket light (10).

Figure 2:
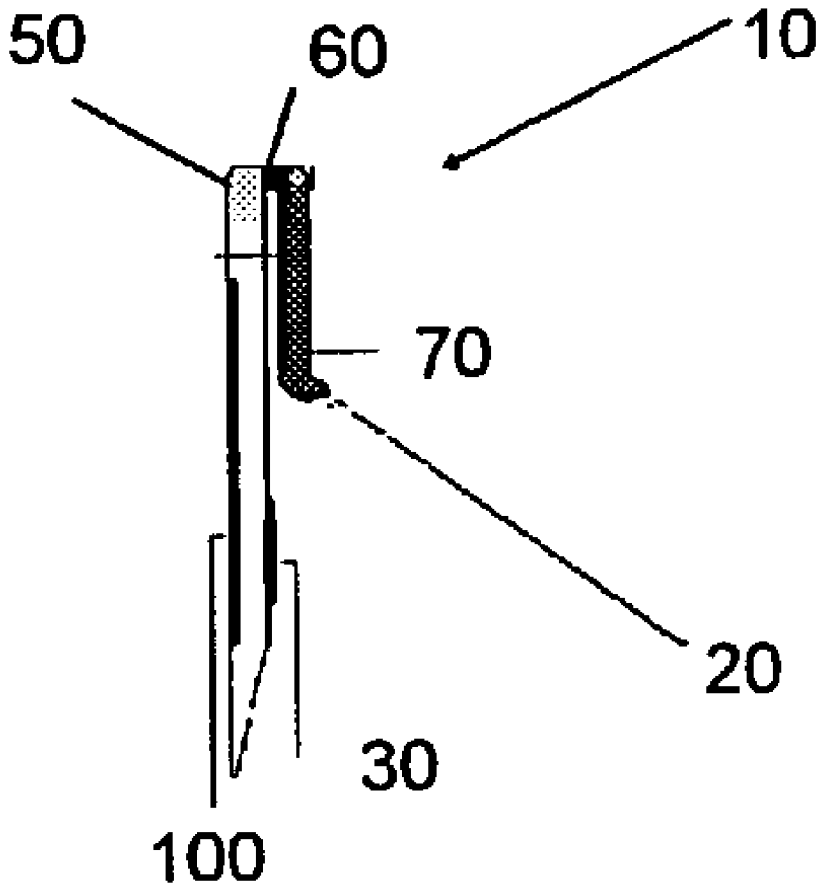
FIG. 2 shows a side view of the present invention.

Turning to FIG. 2, we have a clear view of the side of the pocket light (10). FIG. 2 shows the sleek design of the pocket light, and the separate members as described above. The outer casing (70), clip member (60), back casing (50), and rear protective plate (100), LED display light (20) and power switch (30) of the pocket light are each shown in FIG. 2. The rear protective plate (100) protects the batteries (40), and circuit board (110) from moisture, or dust. The rear protective plate (100) is easily removable to replace the batteries (40) or wiring (not shown) as necessary. The outer casing (70), back casing (50), rear protective plate (100) and clip member (60) are made of a high density plastic composite, or an aluminum alloy which is water resistant and durable for extended use of the pocket light (10). In separate embodiments of the pocket light (10) the back casing (50), exterior casing (70), clip member (60) and rear protective plate (100) could be constructed in a waterproof manner.

Figure 3:
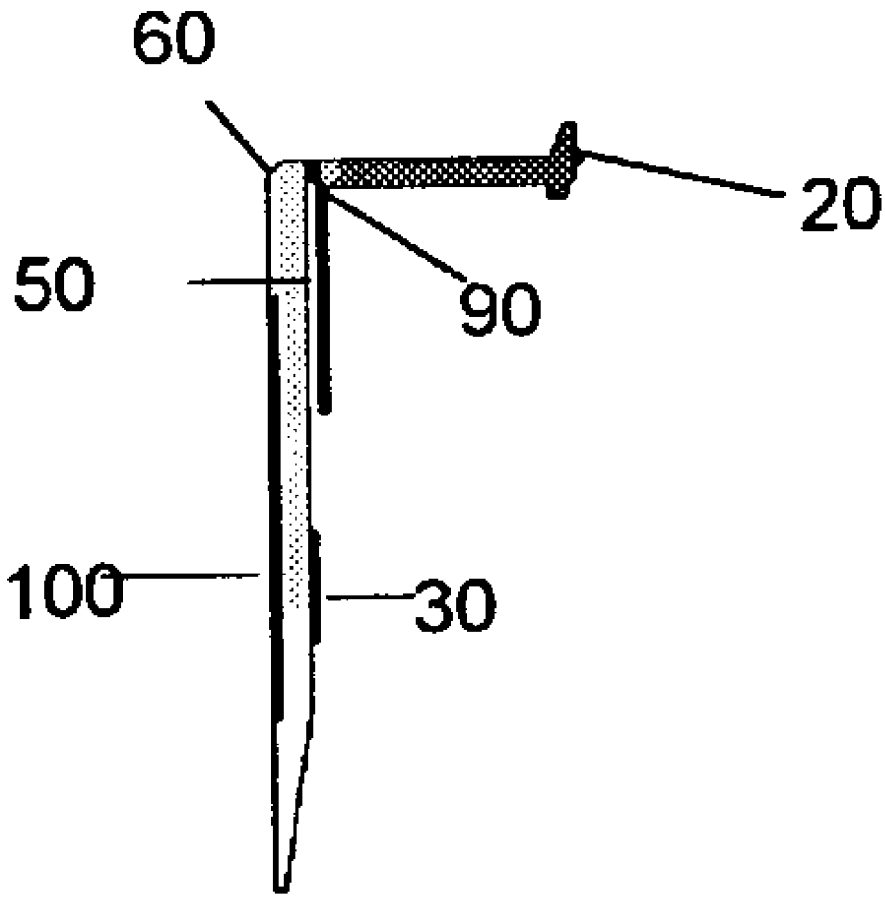
FIG. 3 shows a side view of the present invention with the exterior casing extended.

FIG. 3 shows a side view of the pocket light (10) with the exterior casing (70) fully extended at an approximate 90 degree angle from the rear casing (50) and level with the clipping member (60). The hinged member (90) allows the user to lock the exterior casing (70) in this position, or at any angle between the closed angle (FIG. 2) and the fully extended angle (FIG. 3). Also shown in FIG. 3 are the power switch (30), LED light display (20), rear casing (50) and rear protective plate (100), previously detailed.

FIG. 4 shows a rear view of the pocket light (10). As is shown the batteries (40) are covered by a rear protective plate (FIG. 2, 100), which can be removed to replace the batteries (40) as necessary. The batteries (40) are connected via wiring (120) to the power switch via circuit board assembly (30) to activate the LED display (20). The power switch (30) is touch sensitive and the user to easily activate the light through the material of a shirt pocket with a push of a finger. The wiring (120) will act as negative and positive charge connectors from each functioning component to the batteries (40) and circuit board (110). The wiring (120) also feeds power source from the batteries (40) to the LED light display (20). The series of wiring (120) are easily manipulated without damage of the circuit board (110) or other interior components of the pocket light (10). The pocket light (20) has an automatic shut off so the LED light display (20) will burn 5 minutes and shut off to minimize depletion of the batteries (40).

The present invention is not limited to the sole embodiments described above, but includes any and all embodiments of the following claims.

What is claimed is:

1. A light for a shirt breast pocket and flap combination, the pocket having a top edge, the flap coving the pocket and the pocket's top edge, comprising;

an outer casing;

a power source, enclosed in said outer casing;

a light display, enclosed in said outer casing;

wherein said outer casing is a waterproof protective casing for the interior workings of the pocket light;

wherein said outer casing has two members;

wherein said two members are joined by a hinge;

wherein said power source is housed in the first of said two members;

wherein said light display is housed in the second of said two members;

wherein the pocket light is activated by a light touch to the first of said members;

wherein there is at least one LED light within said light display;

wherein said pocket light is worn by a user by placing said first member in a shirt or other pocket, and bending said second member on the exterior of the pocket by means of said hinge;

wherein said first member fits within the interior the pocket;

wherein said hinge reaches the top edge of the pocket;

wherein said second member is disposed outside of the pocket.

2. A pocket light as in claim 1, wherein said second member is smaller than a pocket flap, and can be disguised while in the pocket.

3. A pocket light as in claim 2, wherein said second member houses said light display at an opposite end from said hinge and said first member.

4. A pocket light as in claim 3, wherein said second member is at a 30 degree downward and outward angle from said first member.

5. A pocket light as in claim 4, wherein said hinge allows a user to place said second member from the 30 degree outward and downward angle to a 90 degree angle from said first member.

6. A pocket light as in claim 5, wherein a user may activate said light display by touching said first member through the shirt pocket.

7. A pocket light as in claim 6, wherein the user may activate said light display and have both hands free to hold documentation or any other item which has need of illumination.

8. A light for a shirt breast pocket and flap combination, the pocket having a top edge, the flap coving the pocket and the pocket's top edge, comprising;

an outer casing;

a power source, enclosed in said outer casing;

a light display, enclosed in said outer casing;

a clip between said first member and said second member;

wherein said outer casing is a waterproof protective casing for the interior workings of the pocket light;

wherein said outer casing has two members, at least one of said two members having a configuration;

wherein said two members we joined by a hinge;

wherein said power source is housed in the first of said two members;

wherein said light display is housed in the second of said two members;

wherein the pocket light is activated by a light touch to the first of said members; and wherein there are at least one LED light within said light display;

wherein said pocket light is worn by a user by placing said first member in a shirt or other pocket, and bending said second member on the exterior of the pocket by means of said hinge;

wherein said first member fits within the interior the pocket;

wherein said hinge reaches the top edge of the pocket;

wherein said second member is disposed outside of the pocket.

* * * * *